US011540610B2

(12) United States Patent
Park et al.

(10) Patent No.: US 11,540,610 B2
(45) Date of Patent: Jan. 3, 2023

(54) HAIR DRYER

(71) Applicant: LG ELECTRONICS INC., Seoul (KR)

(72) Inventors: Goondong Park, Seoul (KR); Kyungseok Min, Seoul (KR); Jounyoung Kim, Seoul (KR); Geunbae Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 91 days.

(21) Appl. No.: 17/124,673

(22) Filed: Dec. 17, 2020

(65) Prior Publication Data

US 2021/0353028 A1 Nov. 18, 2021

(30) Foreign Application Priority Data

May 12, 2020 (KR) ..... 10-2020-0056535

(51) Int. Cl.
*A45D 20/12* (2006.01)

(52) U.S. Cl.
CPC ..... *A45D 20/12* (2013.01)

(58) Field of Classification Search
CPC ..... A45D 20/12
USPC ..... 34/95–100
See application file for complete search history.

(56) References Cited

U.S. PATENT DOCUMENTS 2,016,096 A 10/1935 Martin
3,006,079 A 10/1961 Ivar
3,840,030 A 10/1974 Baker
4,197,448 A 4/1980 Hari
4,596,921 A 6/1986 Hersh
4,721,121 A 1/1988 Adams
4,936,027 A 6/1990 Tsuji
5,074,006 A 12/1991 Eremita
5,875,562 A 3/1999 Fogarty
6,178,591 B1 * 1/2001 Dussourd ..... A47L 9/165 15/326
6,490,756 B2 * 12/2002 Marshall ..... A01G 20/47 15/412

(Continued)

FOREIGN PATENT DOCUMENTS

CN 108206600 6/2018
CN 109674176 4/2019

(Continued)

OTHER PUBLICATIONS

International Search Report dated Feb. 8, 2021 issued in Application No. PCT/KR2020/012276.

(Continued)

*Primary Examiner* — Stephen M Gravini
(74) *Attorney, Agent, or Firm* — Ked & Associates

(57) ABSTRACT

A hair dryer is provided that may include a main body including a discharge outlet through which fluid may be discharged outside of the main body, a handle that extends from the main body, including an inlet through which fluid enters the handle, a flow path that extends from the inlet to the discharge outlet, a fan provided inside of the handle, and provided in the flow path to blow the fluid, and a noise attenuation space provided inside of the handle, and to surround at least a portion of the fan along an inner circumferential direction of the handle, attenuating noise generated by the fan.

23 Claims, 7 Drawing Sheets

(56) References Cited

U.S. PATENT DOCUMENTS

| | | | | |
|---|---|---|---|---|
| 6,755,278 | B2 | 6/2004 | Huhn | |
| 7,093,376 | B2 | 8/2006 | Regen | |
| 8,434,238 | B2 | 5/2013 | Gross et al. | |
| 8,782,920 | B2 | 7/2014 | Marthinsen et al. | |
| 8,893,400 | B2 | 11/2014 | Carme | |
| 9,138,118 | B2 | 9/2015 | Kim et al. | |
| 9,173,468 | B2 * | 11/2015 | Moloney | A45D 20/12 |
| 9,414,662 | B2 | 8/2016 | Moloney et al. | |
| 9,420,864 | B2 | 8/2016 | Gammack et al. | |
| 9,420,865 | B2 | 8/2016 | Gammack et al. | |
| 9,512,959 | B2 | 12/2016 | Atkinson | |
| 9,687,058 | B2 | 6/2017 | Atkinson | |
| 9,808,065 | B2 | 11/2017 | Moloney et al. | |
| 9,808,066 | B2 | 11/2017 | Moloney et al. | |
| 9,986,810 | B2 | 6/2018 | Bobillier et al. | |
| 10,021,951 | B2 | 7/2018 | Bobillier et al. | |
| 10,064,470 | B2 | 9/2018 | Warne | |
| 10,080,414 | B2 | 9/2018 | Douglas et al. | |
| 10,085,538 | B2 | 10/2018 | Saunders et al. | |
| 10,165,843 | B2 | 1/2019 | Hedges | |
| 10,441,050 | B2 * | 10/2019 | Blanc | A45D 20/12 |
| 10,608,297 | B2 | 3/2020 | Goldman et al. | |
| 10,736,477 | B2 | 8/2020 | Kim et al. | |
| 10,859,290 | B2 * | 12/2020 | Herweck | F24F 5/0017 |
| 10,869,529 | B2 | 12/2020 | Chia et al. | |
| 2011/0010958 | A1 * | 1/2011 | Clark | A45D 20/10 34/97 |
| 2013/0269201 | A1 | 10/2013 | Courtney et al. | |
| 2015/0007443 | A1 | 1/2015 | Gammack et al. | |
| 2015/0082652 | A1 | 3/2015 | Atkinson | |
| 2016/0166033 | A1 | 6/2016 | Kerr et al. | |
| 2016/0235178 | A1 * | 8/2016 | Atkinson | F26B 21/003 |
| 2016/0298635 | A1 * | 10/2016 | Su | F04D 29/325 |
| 2018/0042356 | A1 * | 2/2018 | Pavis | A45D 20/10 |
| 2018/0049532 | A1 | 2/2018 | Hsu | |
| 2019/0116955 | A1 | 4/2019 | Atkinson et al. | |
| 2020/0085251 | A1 | 3/2020 | Youn et al. | |
| 2021/0007293 | A1 * | 1/2021 | Stimpson | F04D 29/664 |
| 2021/0321738 | A1 | 10/2021 | Ni | |
| 2021/0345750 | A1 * | 11/2021 | Depoyian | A45D 20/12 |
| 2021/0353026 | A1 | 11/2021 | Min et al. | |
| 2021/0353028 | A1 * | 11/2021 | Park | A45D 20/10 |
| 2021/0353032 | A1 | 11/2021 | Min et al. | |
| 2022/0007809 | A1 * | 1/2022 | Wang | A45D 20/12 |
| 2022/0160096 | A1 | 5/2022 | Harrison | |

FOREIGN PATENT DOCUMENTS

| | | | | |
|---|---|---|---|---|
| CN | 110537768 | | 12/2019 | |
| EP | 3 626 109 | | 5/2021 | |
| GB | 2543751 B | * | 4/2019 | A45D 20/00 |
| JP | 2006-288516 | | 10/2006 | |
| JP | 2014-217770 | | 11/2014 | |
| JP | 2016-135096 | | 7/2016 | |
| JP | 2016-185402 | | 10/2016 | |
| JP | 6512713 B2 | * | 5/2019 | A45D 20/00 |
| KR | 20-1999-0010222 | | 3/1999 | |
| KR | 10-2012-0085007 | | 7/2012 | |
| KR | 10-1285469 | | 7/2013 | |
| KR | 10-2015-0072610 | | 6/2015 | |
| KR | 10-2016-0020555 | | 2/2016 | |
| KR | 10-2016-0020556 | | 2/2016 | |
| KR | 10-2016-0052719 | | 5/2016 | |
| KR | 10-2016-0096888 | | 8/2016 | |
| KR | 10-2017-0095961 | | 8/2017 | |
| KR | 10-2018-0069051 | | 6/2018 | |
| KR | 10-2020-0116277 | | 10/2020 | |
| WO | WO-2017068322 A1 | * | 4/2017 | A45D 20/00 |
| WO | WO-2021230442 A1 | * | 11/2021 | A45D 20/12 |

OTHER PUBLICATIONS

Taiwanese Office Action dated Jul. 21, 2021 issued in TW Application No. 109135772.

Taiwanese Office Action dated Jul. 21, 2021 issued in TW Application No. 109135773.

International Search Report dated Aug. 17, 2021 issued in PCT Application No. PCT/KR2020/012328.

International Search Report dated Aug. 17, 2021 issued in PCT Application No. PCT/KR2020/015109.

Korean Notice of Allowance issued in Application No. 10-2020-0056534 dated Nov. 18, 2021.

Korean Notice of Allowance issued in Application No. 10-2020-0056535 dated Nov. 19, 2021.

Korean Notice of Allowance issued in Application No. 10-2020-0056533 dated Jan. 18, 2022.

U.S. Appl. No. 17/078,311, filed Oct. 23, 2020.

United States Office Action dated Dec. 17, 2021 issued in co-pending related U.S. Appl. No. 17/078,311.

U.S. Office Action issued in U.S. Appl. No. 17/084,668 dated Jun. 28, 2022.

U.S. Appl. No. 17/124,673, filed Dec. 17, 2020.

U.S. Appl. No. 17/084,668, filed Oct. 30, 2020.

* cited by examiner

HAIR DRYER

CROSS-REFERENCE TO RELATED APPLICATION(S)

This application claims the benefit of the Korean Patent Application No. 10-2020-0056535, filed in Korea on May 12, 2020, which is hereby incorporated by reference as if fully set forth herein.

BACKGROUND

1. Field

A hair dryer is disclosed herein.

2. Background

A hair dryer for discharging gas or fluid, such as air, through a gas discharge outlet may be used when a user removes water from his/her hair to a desired level in a state in which the hair is wet or changes a hair style from a current hair style to a desired hair style. The hair dryer may be provided with a fan unit for blowing gas therein, and may be designed to be conveniently used by a user.

U.S. Patent Publication No. 2019/0116955, which is hereby incorporated by reference, discloses a hair dryer, a center of gravity of which is arranged to be adjacent to a handle portion, while as a fan unit and a gas inlet are arranged in the handle portion grasped by a user. In this case, a wrist load of a user who controls a gas discharge direction of a gas discharge outlet to a desired direction by grasping the handle portion may be reduced, whereby user convenience may be improved.

However, the hair dryer disclosed in U.S. Patent Publication No. 2019/0116955 is provided with the fan unit inside of the handle portion directly grasped by a user, and the fan unit may generate vibration, which is transferred to the user or causes noise.

For example, the user receives vibration of the fan unit in a state in which the user grasps the handle portion, and noise may be generated by flow of gas by means of the fan unit. Such noise may be generated at a side of the handle portion in accordance with a position of the fan unit. Therefore, it is important to remove user displeasure in the art of hair dryers by effectively attenuating vibration or noise generated by the hair dryer.

BRIEF DESCRIPTION OF THE DRAWINGS

Embodiments will be described in detail with reference to the following drawings in which like reference numerals refer to like elements, and wherein.

DETAILED DESCRIPTION

Description of embodiments is given with reference to the accompanying drawings to enable those skilled in the art to realize and implement the embodiments. Embodiments may, however, be embodied in many different forms and should not be construed as being limited to the embodiments set forth herein. For definite description, portions of drawings having no relation with the description will be omitted, and the same or like reference numbers will be used throughout the drawings to refer to the same or like components. Repeated description for the same elements will be omitted.

The expression that an element is "connected" or "coupled" to another element should be understood that the element may directly be connected or coupled to another element, a third element may be interposed between the corresponding elements, or the corresponding elements may be connected or coupled to each other through a third element. On the other hand, the expression that an element is "directly connected" or "directly coupled" to another element" means that no third element exists therebetween.

The terms used in this specification are intended to describe the embodiments, and should not be restrictive.

Also, it is to be understood that the singular expression used in this specification includes the plural expression unless defined differently on the context.

In this specification, it is to be understood that the terms such as "include" and "has" are intended to designate that features, numbers, steps, operations, elements, parts, or their combination, which are disclosed in the specification, exist, and are intended not to previously exclude the presence or optional possibility of one or more other features, numbers, steps, operations, elements, parts, or their combinations.

Also, in this specification, the terms such as "and/or" include a combination of a plurality of items which are disclosed or any one of the plurality of items. In this specification, "A or B" may include "A", "B" or "both of A and B".

Figure 1:
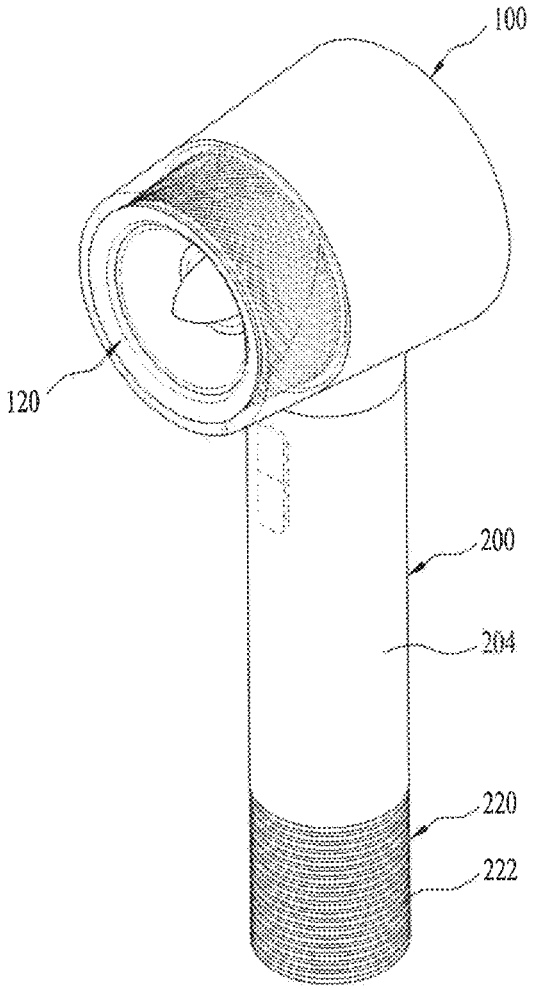
FIG. 1 is a view illustrating a hair dryer according to an embodiment.
Figure 2:
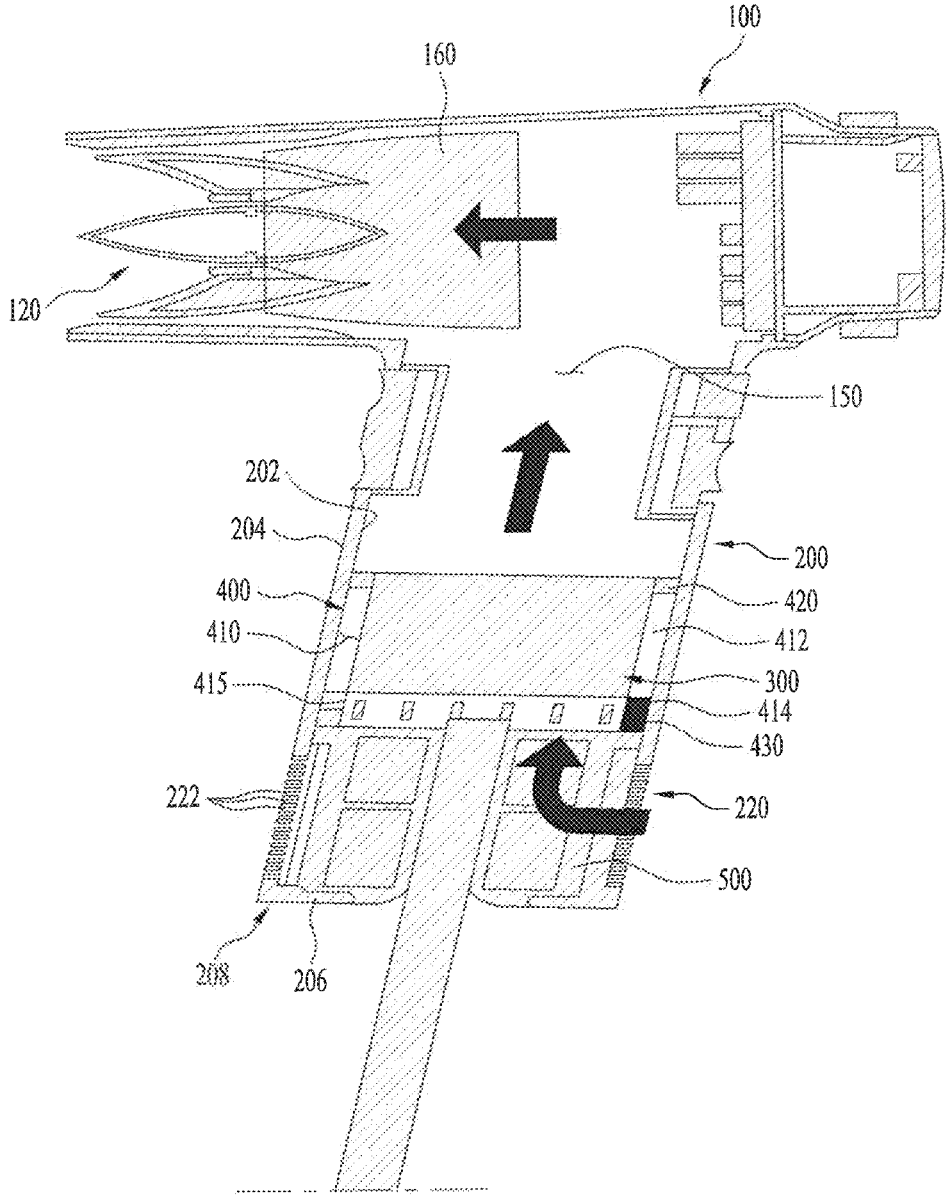
FIG. 2 is a view illustrating an inside of a hair dryer according to an embodiment.

FIG. 1 is a view illustrating a hair dryer according to an embodiment. FIG. 2 is a view illustrating an inside of a hair dryer according to an embodiment.

The hair dryer according to an embodiment, as shown in FIG. 1, may include a main body 100, and a handle portion (handle) 200. Also, the main body 100 may include a gas discharge outlet (discharge outlet) 120 for discharging gas or fluid, such as air, externally entering therein.

The main body 100, as shown in FIG. 2, may be provided with a gas path (flow path) 150 therein, through which gas may flow. The gas path 150 may extend from the handle portion 200 to the inside of the main body 100. The gas path 150 may be formed by the inside of the main body 100 and the inside of the handle portion 200, and may be defined as an area extending from a gas inlet (inlet) 220 to the gas discharge outlet 120.

The main body 100 may be provided with the gas discharge outlet 120 through which gas flowing along the gas path 150 may be discharged to the outside. The main body 100 may have a shape extended in parallel with a gas discharge direction of the gas discharge outlet 120, and may be provided to have various cross-sectional shapes, such as a circle or a polygonal shape.

The gas flowing inside of the main body 100 may enter the main body 100 through the gas inlet 220, and the gas inlet 220 may be provided in the main body 100 or the handle portion 200. If the gas inlet 220 is provided in the handle portion 200 as shown in FIGS. 1 and 2, the gas path 150 may extend from the handle portion 200 into the main body 100, more specifically, from the gas inlet 220 to the gas discharge outlet 120. External gas may enter the main body 100 through the gas inlet 220 provided in the main body 100 or the handle portion 200, and then flow along the gas path 150, whereby the gas may be discharged to the outside through the gas discharge outlet 120 provided in the main body 100.

The handle portion 200 may extend from the main body 100. Referring to FIGS. 1 and 2, the handle portion 200 may extend downwardly from the main body 100 as shown.

The handle portion 200 may be molded in a single body with the main body 100 or may be manufactured separately, whereby the handle portion 200 may be coupled to the main body 100. If the handle portion 200 is manufactured separately from the main body 100 and then coupled to the main body 100, the handle portion 200 may be provided to be fixed or vary in a lengthwise direction of the main body 100. For example, the handle portion 200 may have a hinge coupling unit, may be coupled to the main body 100, and thus, may be varied in the lengthwise direction, that is, bent with respect to the main body 100.

The handle portion 200 may be a portion grasped by a user with his/her hand, and therefore, may have a shape for improving grip convenience. The handle portion 200 may extend in various directions, but a direction of the handle portion 200 extended from the main body 100 will be described based on a downward direction for convenience of description.

That is, in embodiments disclosed herein, an upward/downward direction may be defined based on the handle portion 200. For example, the handle portion 200 may have a shape extended downwardly from the main body 100, and the main body 100 may be arranged upwardly. Therefore, the upward/downward direction does not always refer to a direction vertical to ground, and may be defined based on the handle portion 200 for convenience of description.

Referring to FIG. 2, the hair dryer according to an embodiment may include a fan unit (fan) 300 that may blow gas and control a speed of the gas discharged through the gas discharge outlet 120. The fan unit 300 may be arranged on or in the gas path 150 to blow the gas, and may be provided inside of the main body 100 or the handle portion 200.

For example, if the gas inlet 220 is arranged in the handle portion 200, the gas path 150 may extend from the gas inlet 220 of the handle portion 200 to the gas discharge outlet 120 of the main body 100, and the fan unit 300 may be arranged on or in the gas path 150 arranged in the handle portion 200.

A temperature control unit (controller) 160 capable of controlling a temperature of the discharged gas may be provided inside of the main body 100. The temperature control unit 160 may be provided in various shapes and various positions. The temperature control unit 160 provided inside of the main body 100 is schematically shown in FIG. 2.

Also, the temperature control unit 160 may be provided in various types. The temperature control unit 160 may heat gas by generating heat after providing a current to a coil type resistor. However, the resistor of the temperature control unit 160 may not be always a coil type, and may be provided in various types, which are capable of controlling a temperature of gas, such as a thermoelement.

An operation method of the hair dryer according to an embodiment will be described together with gas flow.

First, a user may manipulate a power button arranged in or on the main body 100 or the handle portion 200. If the power button is powered on, the fan unit 300 is operated and gas enters the hair dryer through the gas inlet 220.

The gas entering the hair dryer through the gas inlet 220 may flow along the gas path 150 by means of the fan unit 300 and then to the gas discharge outlet 120. The gas may be discharged from the gas discharge outlet 120 and then provided to the user. In this process, a flow velocity of the gas on or in the gas path 150 may be controlled by the fan unit 300, and its temperature may be controlled by the temperature control unit 160.

The hair dryer according to an embodiment may include a controller. The controller may be connected with the fan unit 300, the temperature control unit 160, the power button, and a manipulation unit to control these components.

Operation of the fan unit 300 and the temperature control unit 160 may be controlled by user manipulation of the manipulation unit, and may automatically be controlled in accordance with an operation mode preset in the controller.

Figure 3:
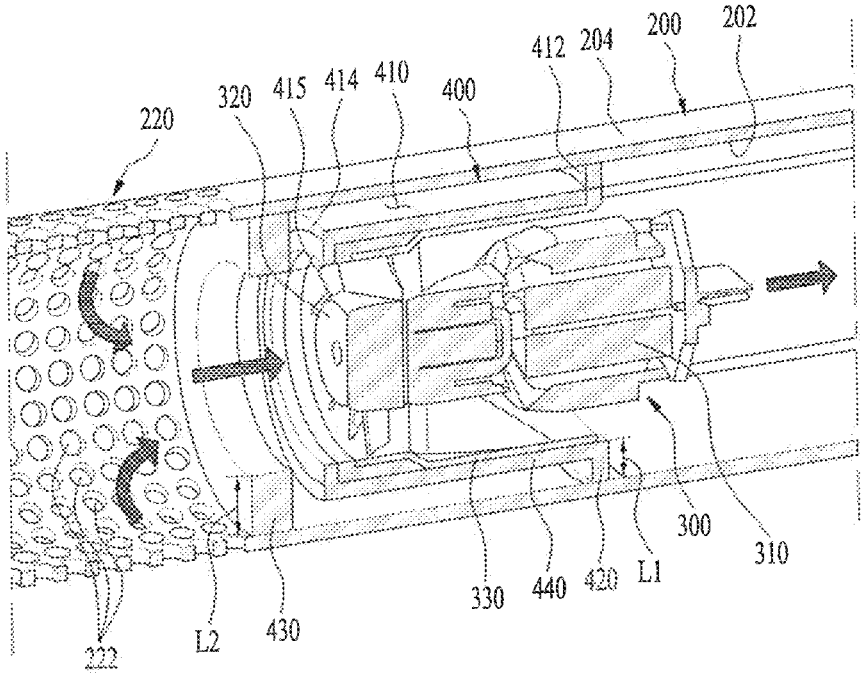
FIG. 3 is a view illustrating a fan unit provided in a handle portion in a hair dryer according to an embodiment.

FIG. 3 shows that the gas inlet 220 is provided in the handle portion 200 and the fan unit 300 is provided inside of the handle portion 200 in accordance with an embodiment. As described above, the hair dryer according to an embodiment may include the main body 100, the handle portion 200, the gas path 150, and the fan unit 300. The main body 100 may include the gas discharge outlet 120 through which the gas is discharged to the outside.

The gas discharge outlet 120 may be provided at an end of one side of the main body 100, and may discharge the gas away from the main body 100. The gas discharge outlet 120 may form one surface of the main body 100, and may form or include one opening as a whole or include a plurality of gas discharge holes separate from one another.

The handle portion 200 may include the gas inlet 200 extended from the main body 100 to allow external gas to enter therein. The gas entering the hair dryer through the gas inlet 220 may be discharged to the outside through the gas discharge outlet 120.

The handle portion 200 may be extended in various directions. For convenience of description, the extended direction of the handle portion 200, that is, the lengthwise direction may be understood as the upward/downward direction.

As set forth above, the up and down direction may not be defined based on the ground. For example, the handle portion 200 may have an inclined lengthwise direction with respect to the ground. In this case, the upward/downward direction may be defined in parallel with the lengthwise direction of the handle portion 200.

The gas path 150 may extend from the gas inlet 220 to the gas discharge outlet 120. As shown in FIG. 2, in one embodiment, the gas inlet 220 may be provided in the handle portion 200, the gas discharge outlet 120 may be provided in the main body 100, and the gas path 150 may extend from the inside of the handle portion 200 to the inside of the main body 100.

Some or a first portion of the gas path 150 may be arranged inside of the main body 100, and the other or a second portion of the gas path 150 may be arranged inside of the handle portion 200. Some of the gas path 150 may be defined by an outer wall of the main body 100, and the other of the gas path 150 may be defined by an outer wall of the handle portion 200.

That is, an inner space of the main body 100 may form some of the gas path 150, and an inner space of the handle portion 200 may form the other of the gas path 150. FIG. 2 shows the gas path 150 extended from the gas inlet 220 of the handle portion 200 to the gas discharge outlet 120 of the main body 100 in accordance with an embodiment.

The fan unit 300 may be provided inside of the handle portion 200, and may be provided on or in the gas path 150 to flow the gas. The fan unit 300 may include a fan motor 310, and a fan (plurality of blades) 320, for example, as described hereinafter. The fan unit 300 may be provided on or in the gas path 150 to generate flow of the gas through rotation of the fan 320.

If a power source is applied to the fan unit 300, the gas in the gas path 150 may flow toward the gas discharge outlet 120 due to rotation of the fan 320, and the gas may enter the gas inlet 220 due to flow of the gas.

As shown in FIGS. 2 and 3, in one embodiment, the fan unit 300 may be provided inside of the handle portion 200. The user may use the hair dryer in a state in which the user grasps the handle portion 200.

Therefore, if the center of gravity of the hair dryer is close to the handle portion 200, the user is likely to control a discharge direction of the hair dryer in a state in which the user grasps the handle portion 200. Therefore, in one embodiment, the fan unit 300 may be arranged inside of the handle portion 200, whereby use convenience of the user may effectively be improved, and the user's wrist load may be reduced.

Referring to FIG. 3, the hair dryer according to an embodiment may include a noise attenuation portion 400. The noise attenuation portion 400 may be provided inside of the handle portion 200, may be provided to surround at least a portion of the fan unit 300 along an inner circumferential direction of the handle portion 200, thereby attenuating noise generated from the fan unit 300.

The noise attenuation portion 400 may surround at least a portion of the fan unit 300 inside of the handle portion 200. The noise attenuation portion 400 may extend along the inner circumferential direction of the handle portion 200, and may be provided to fully surround the fan unit 300.

The noise attenuation portion 400 may attenuate noise generated from an inner side where the fan unit 300 is arranged. The noise attenuation portion 400 may be provided in various types to reduce inner noise transmitted to the outside.

For example, the noise attenuation portion 400 may be provided to include a material having low transmittance of noise from a specific frequency area and a space where air, for example, is charged, or may be provided in an active type, such as a piezoelectric element to generate vibration through electric energy, for example, thereby counterbalancing noise.

Flow of the gas may occur due to the fan unit 300, and noise caused by flow of the gas generated by operation of the fan unit 300 may exist together with operation noise of the fan unit 300. Therefore, in one embodiment, the fan unit 300 may be provided inside of the handle portion 200 to improve use convenience and at the same time the noise attenuation portion 400 extended from the inside of the handle portion 200 along the inner circumferential direction of the handle portion 200 to surround the fan unit 300 may be provided, whereby vibration or noise generated by the fan unit 300 may effectively be attenuated to improve use of the hair dryer.

Referring to FIG. 3, in one embodiment, the noise attenuation portion 400 may include a noise attenuation space 410 where noise generated from the fan unit 300 is attenuated. The noise attenuation space 410 may be provided between the inner circumferential surface 202 of the handle portion 200 and the fan unit 300 to surround the fan unit 300.

The noise attenuation space 410 formed in the noise attenuation portion 400 is shown in FIG. 3. The noise attenuation space 410 may be a means for attenuating noise transferred from the fan unit 300 to the outside of the handle portion 200.

The noise attenuation space 410 may be provided between an inner circumferential surface 202 of the handle portion 200 and the fan unit 300. The noise attenuation space 410 may be defined by the inner circumferential surface 202 of the handle portion 200 and the outer circumferential surface of the fan unit 300 or may be arranged between the inner circumferential surface 202 of the handle portion 200 and the outer circumferential surface of the fan unit 300.

The noise attenuation space 410 formed between the inner circumferential surface 202 of the handle portion 200 and the fan unit 300 and may extend along the inner circumferential surface of the handle portion 200 to have a ring shaped section in accordance with an embodiment, as shown in FIG. 3. The fan unit 300 may be surrounded by the noise attenuation space 410 and transfer operational nose and gas noise attenuated by the noise attenuation space 410 to the outside. One or a first end 412 of the noise attenuation space 410, which faces the main body 100, may be closed and detached or separated from the gas path 150, and the other or a second end 414, which faces the gas inlet 220, may include an opening area (opening) 415 that provides communication between the noise attenuation space 410 and the gas path 150.

The fan unit 300 may be arranged between the gas discharge outlet 120 and the gas inlet 220. Also, the fan unit 300 may be provided in the handle portion 200 and arranged to be closer to the gas inlet 220.

The noise attenuation space 410 may be provided such that the one end 412 facing the main body 100 is detached or separated from the gas path 150. That is, the one end 412 of the noise attenuation space 410 may be closed and detached or separated from the gas path 150. If the lengthwise direction of the handle portion 200 is defined as the upward/downward direction, an upper end of the noise attenuation space 410 may be shielded from the gas path 150.

The other end 414 of the noise attenuation space 410, which is arranged at an opposite side of the main body 100, that is, the other end 414 facing the gas inlet 220 may be open with respect to the gas path 150. A lower end of the noise attenuation space 410 may communicate with the gas path 150 based on the lengthwise direction of the handle portion 200.

The other end 414 of the noise attenuation space 410 may communicate with the gas path 150 and be used as a resonant space of a Helmholtz resonator. That is, the noise attenuation portion 400 may correspond to a Helmholtz resonator that uses the noise attenuation space 410.

In the relationship with the gas path 150, the one end 412 of the noise attenuation space 410 may be closed and the other end 414 of the noise attenuation space 410 may be open, whereby the noise attenuation space 410 that communicates with the gas path 150 may be provided so as not to generate flow of the gas therein due to closure of the one end 412. The gas inside of the noise attenuation space 410, for example, air may generate resonance with noise generated from the gas path 150, whereby sound absorption may be made. A resonant frequency of the noise attenuation space 410 may be determined by an area or total volume of the other end 414 exposed to the gas path 150.

That is, design characteristics of the noise attenuation space 410 may be controlled to control a target frequency for noise attenuation, that is, a resonant frequency. As a result, a frequency area that requires noise attenuation may be determined and the noise attenuation space 410 corresponding to the corresponding frequency area may be formed, whereby a noise attenuation effect may be implemented.

Figure 7:
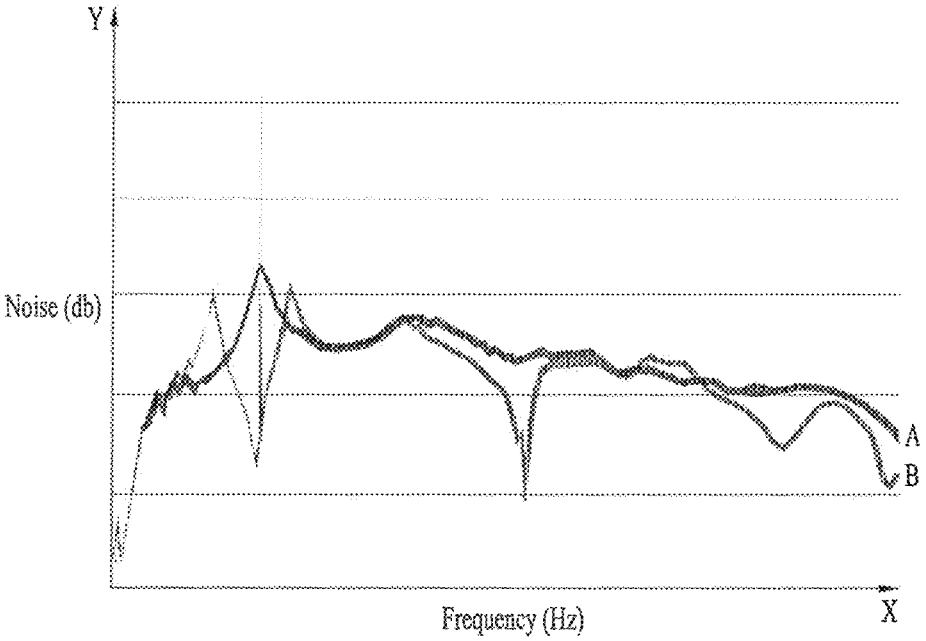
FIG. 7 is a graph illustrating a result of noise attenuation by a noise attenuation portion in a hair dryer according to an embodiment.

FIG. 7 is a graph illustrating an attenuation effect of noise generated from the fan unit 300 by the noise attenuation space 410 according to one embodiment of the present disclosure. The corresponding graph is a result of noise measured at a downstream of the fan unit 300 based on gas flow.

Referring to FIG. 7, the X axis denotes a frequency (Hz), and the Y axis denotes a size (db) of noise. A measurement result A shown on the graph indicates a state in which the noise attenuation space 410 is not formed, and a measurement result B indicates a state in which the noise attenuation space 410 is formed.

In comparison between the measurement results A and B, it is noted that noise is remarkably reduced in a specific frequency area by the noise attenuation space 410. In the graph of FIG. 7, the noise attenuation space 410 is designed using a specific frequency area having a maximum noise size in the measurement result A as a target, whereby the measurement result B indicates that noise in the frequency area having a maximum noise size in the measurement result A is remarkably reduced.

In this way, turbulence is intensified and noise increased in the fan unit 300 as the gas passes through the fan unit 300, where the noise attenuation space 410 surrounding the fan unit 300 is formed. As a result, noise generated from the fan unit 300 may be reduced remarkably.

This noise attenuation effect may affect noise transfer from the inside to the outside of the handle portion 200 and also affect noise existing in a gas flow inside the handle portion 200, whereby the noise attenuation effect may be implemented.

Referring to FIG. 3, the fan unit 300 may include the fan motor 310 and the fan 320. The fan 320 of the fan unit 300 may be rotated by the fan motor 310, and gas flow may occur in accordance with rotation of the fan 320.

A motor shaft of the fan motor 310 may be parallel with the lengthwise direction of the handle portion 200 or the extension direction of the gas path 150. For example, if the lengthwise direction of the handle portion 200 is defined as the upward/downward direction, the motor shaft of the fan motor 310 may be provided to be parallel with the up and down direction, and the fan 320 may be rotated along the inner circumferential direction of the handle portion 200. The inner circumferential direction of the handle portion 200 may be understood as the same as an outer circumferential direction of the handle portion 200 or a circumferential direction of the handle portion 200.

The fan 320 of the fan unit 300 may be arranged at an end portion or end facing for the gas inlet 220. That is, the motor shaft of the fan motor 310 may be provided to protrude toward the gas inlet 220, and the fan 320 may be coupled to the motor shaft and provided at the end portion of the fan unit 300, which faces the gas inlet 220.

The other end 414 of the noise attenuation portion 400, which faces the gas inlet 220 in the noise attenuation area, may communicate with the gas path 150, and the fan 320 of the fan unit 300 may be provided at the end portion facing the gas inlet 220, whereby the fan 320 and the other end 414 of the noise attenuation portion 410 may be arranged to be adjacent to each other.

Turbulence of the gas inside of the handle portion 200 may be intensified in the process of passing through the gas inlet 220 and entering the handle portion 200, and may also be intensified while passing through the fan 320 of the fan unit 300. If turbulence of the gas is intensified, noise may be generated due to gas flow.

Therefore, the noise attenuation space 410 may communicate with the gas path 150 at the other end 414 close to the gas inlet 220, and the fan 320 of the fan unit 300 may also be arranged toward the gas inlet 220, whereby noise of the gas increased by the gas inlet 220 and the fan 320 may be attenuated effectively by the noise attenuation space 410.

As shown in FIG. 3, the opening area 415 of the noise attenuation space 410 may be provided to be closer to the gas inlet 220 than the fan 320. That is, the opening area 415 may be arranged to be lower than the gas inlet 220.

If the noise attenuation space 410 communicates with the gas path 150 through the opening area 415 of the other end 414 and the fan 320 is provided at the end portion facing the gas inlet 220 in the fan unit 300, the opening area 415 of the noise attenuation space 410 and at least a portion of the fan 320 may overlap with each other along a radial direction of the handle portion 200.

In this case, the gas existing in the opening area 415 may flow due to rotation of the fan 320. This may reduce the noise attenuation effect according to the noise attenuation space 410.

Therefore, as the opening area 415 of the noise attenuation space 410 that communicates with the gas path 150 is arranged to be closer to the gas inlet 220 than the fan 320, gas existing in the opening area 415 may be affected by the fan 320 within a minimum range, and gas noise generated through the gas inlet 220 and the fan 320 may be attenuated effectively.

As shown in FIG. 3, the hair dryer according to an embodiment may further include a first closure portion 420. The first closure portion 420 may protrude from the inner circumferential surface 202 of the handle portion 200, may have a ring shape extended along the inner circumferential surface of the handle portion 200, and may be provided to close the one end 412 of the noise attenuation space 410.

The term "ring shape" may refer to a section having a closed curve, and a closed section formed inside. The closed curve formed by the ring shape may correspond to a circle or a polygonal shape.

The first closure portion 420 may protrude from the inner circumferential surface 202 of the handle portion 200 to the inner side of the handle portion 200. The first closure portion 420 may be manufactured separately from the handle portion 200, and may be coupled to the inner circumferential surface 202 of the handle portion 200 or molded in a single body with the inner circumferential surface of the handle portion 200.

The one end 412 of the noise attenuation space 410 may be closed from the gas path 150 by the first closure portion 420. The first closure portion 420 may be provided to face the one end 412 of the noise attenuation space 410 to close the one end 412.

The noise attenuation space 410 may be formed between the inner circumferential surface 202 of the handle portion 200 and the outer circumferential surface of the fan unit 300. The one end 412 may be closed by the first closure portion 420 based on a direction facing the main body 100. That is, the first closure portion 420 may define at least a portion of the one end 412 of the noise attenuation space 410, and may be provided to close the one end 412 of the noise attenuation space 410 along the lengthwise direction of the handle portion 200.

The fan unit 300 may be provided to be connected with the first closure portion 420 and spaced apart from the inner circumferential surface 202 of the handle portion 200. As the first closure portion 420 is provided to protrude from the inner circumferential surface 202 of the handle portion 200, the fan unit 300 may be coupled to the first closure portion 420, whereby the fan unit 300 may be fixed to the inside of the handle portion 200 in a state in which it is spaced apart from the inner circumferential surface 202 of the handle portion 200.

Figure 4:
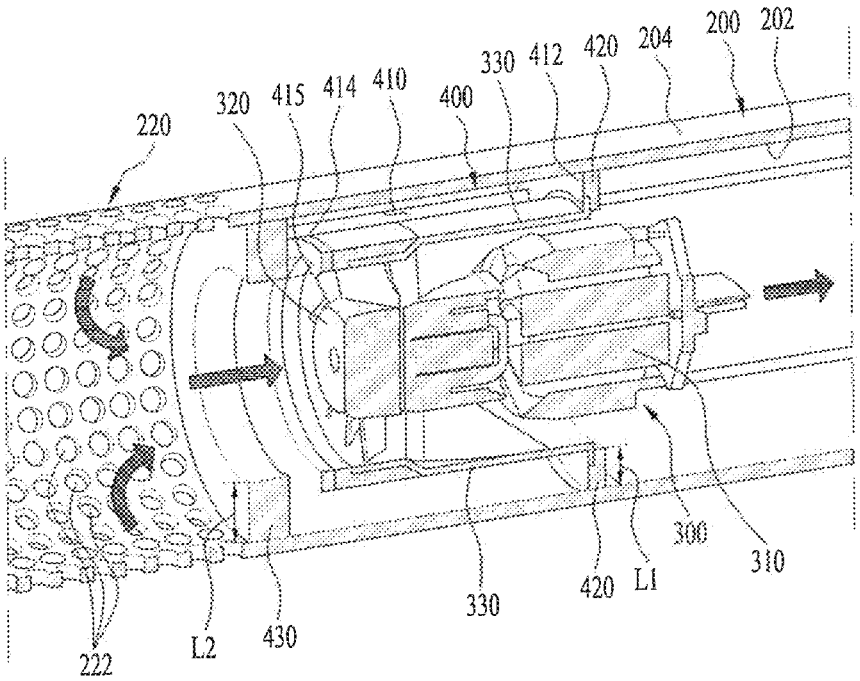
FIG. 4 is a view illustrating a fan unit holder removed from a handle portion of FIG. 3.

FIG. 3 shows that the fan unit 300 is accommodated in the fan unit holder 440 provided in the first closure portion 420 in accordance with an embodiment. FIG. 4 shows that a motor housing 330 of the fan unit 300 is coupled to the first closure portion 420.

Referring to FIG. 3, the fan unit 300 may further include the motor housing 330 in which the fan motor 310 may be accommodated. One or a first end of the motor housing 330, which faces the main body 100, may be coupled to the first closure portion 420, and the noise attenuation space 410 may be formed between the motor housing 330 and the inner circumferential surface 202 of the handle portion 200.

The motor housing 330 may form at least a portion of an external appearance of the fan unit 300. The fan motor 310 may be accommodated in the motor housing 330, and the fan unit 300 may be coupled to the first closure portion 420 and then fixed to the inside of the handle portion 200. In this case, the noise attenuation space 410 may be formed between the motor housing 330 and the inner circumferential surface 202 of the handle portion 200. That is, the noise attenuation space 410 may be defined by the outer circumferential surface of the motor housing 330 and the inner circumferential surface 202 of the handle portion 200.

As the one end of the motor housing 330 may be coupled to the first closure portion 420, the one end 412 of the noise attenuation space 410 may be defined by the inner circumferential surface 202 of the handle portion 200, the first closure portion 420, and the motor housing 330, and may be closed from the gas path 150.

Unlike FIG. 4, the fan unit 300 coupled to the first closure portion 420 through the fan unit holder 440 is shown in FIG. 3. Referring to FIG. 3, the hair dryer according to an embodiment may further include the fan unit holder 440 extended from the first closure portion 420 to the gas inlet 220, accommodating the fan unit 300 therein. The noise attenuation space 410 may be formed between an outer side of the fan unit holder 440 and the inner circumferential surface 202 of the handle portion 200.

At least a portion of the fan unit holder 440 may extend from the first closure portion 420 to the gas inlet 220. That is, at least a portion of the fan unit holder 440 may extend from the first closure portion 420 toward the fan 320 of the fan unit 300. At least a portion of the fan unit holder 440 may extend downwardly from the first closure portion 420 based on the lengthwise direction of the handle portion 200.

The outer circumferential surface of the fan unit holder 440 may extend toward the inner circumferential direction of the handle portion 200 to have a hollow pipe or cylindrical shape. The fan unit 300 may be accommodated in the hollow area. The fan unit holder 440 may have an open end facing the gas inlet 220, and the fan unit 300 may be provided in the fan unit holder 440 to flow gas through rotation of the fan 320.

The fan unit holder 440 may be molded in a single body with the first closure portion 420, or may be manufactured separately from the first closure portion 420 and then coupled to the first closure portion 420.

The noise attenuation space 410 may be formed between the fan unit holder 440 and the inner circumferential surface 202 of the handle portion 200. That is, the inner side of the noise attenuation space 410 may be defined by the fan unit holder 440, and the outside of the noise attenuation space 410 may be defined by the inner circumferential surface 202 of the handle portion 200. In this case, the one end 412 of the noise attenuation space 410 may be spaced apart from the gas path 150 by the fan unit holder 440 and the first closure portion 420.

Referring to FIGS. 3 and 4, the hair dryer according to an embodiment may further include a second closure portion 430. The second closure portion 430 may be spaced apart from the fan unit 300 toward the gas inlet 220, protrude from the inner circumferential surface 202 of the handle portion 200, and extend along the inner circumferential direction of the handle portion 200 to have a ring shape. The opening area 415 may be formed between the fan unit 300 and the second closure portion 430.

The second closure portion 430 may be spaced apart from the end facing the gas inlet 220 in the fan unit 300, toward the gas inlet 220. That is, the second closure portion 430 may be arranged to be downwardly spaced apart from the fan unit 300 based on the lengthwise direction of the handle portion 200.

Similarly to the first closure portion 420, the second closure portion 430 may have a ring shape protruding from the inner circumferential surface 202 of the handle portion 200. At least one surface of the other end 414 of the noise attenuation space 410 may be defined by the second closure portion 430. That is, the opening area 415 of the noise attenuation space 410 may be formed as the fan unit 300 and the second closure portion 430 are spaced apart from each other, whereby the noise attenuation space 410 may be provided to communicate with the gas path 150 through the opening area 415.

As the opening area 415 of the noise attenuation space 410 is formed between the second closure portion 430 and the fan unit 300, noise may be transferred from the gas path 150, and a noise attenuation effect may be improved. The opening area 415 according to an embodiment is shown in FIGS. 3 and 4.

The second closure portion 430 may be provided in a ring shape having a cross-sectional shape of a circle or a polygon, and may be molded in a single body with the handle portion 200 or manufactured separately from the handle portion 200 and then coupled to the inner circumferential surface 202 of the handle portion 200.

A protrusion height (height) of the second closure portion 430 may be higher than a protrusion height (height) of the first closure portion 420, and the opening area 415 may be open to cross the lengthwise direction of the handle portion 200. Referring to FIGS. 3 and 4, the protrusion height L1 of the first closure portion 420 may be designed to be lower than the protrusion height L2 of the second closure portion 430. That is, the protrusion height L2 of the second closure portion 430 may be provided to be higher than the protrusion height L1 of the first closure portion 420. The protrusion height of the first closure portion 420 and the second closure portion 430 may refer to a height from the inner circumferential surface 202 of the handle portion 200.

The one end 412 of the noise attenuation space 410 may be defined by the first closure portion 420, and the protrusion height L2 of the second closure portion 430, which defines the other end 414 of the noise attenuation space 410, may be higher than the protrusion height L1 of the first closure portion 420, whereby the other end 414 of the noise attenuation space 410 may be open toward the gas path 150 along a direction crossing the lengthwise direction of the handle portion 200, that is, the radial direction of the handle portion 200 without being open in the lengthwise direction of the handle portion 200.

That is, the opening area 415 may be formed between the noise attenuation space 410 and the gas path 150 based on the radial direction of the handle portion 200. Therefore, the noise attenuation space 410 may communicate with the gas path 160 along the radial direction of the handle portion 200, whereby noise may be transferred to the noise attenuation space 410, and a Helmholtz resonant effect may be maximized.

Figure 5:
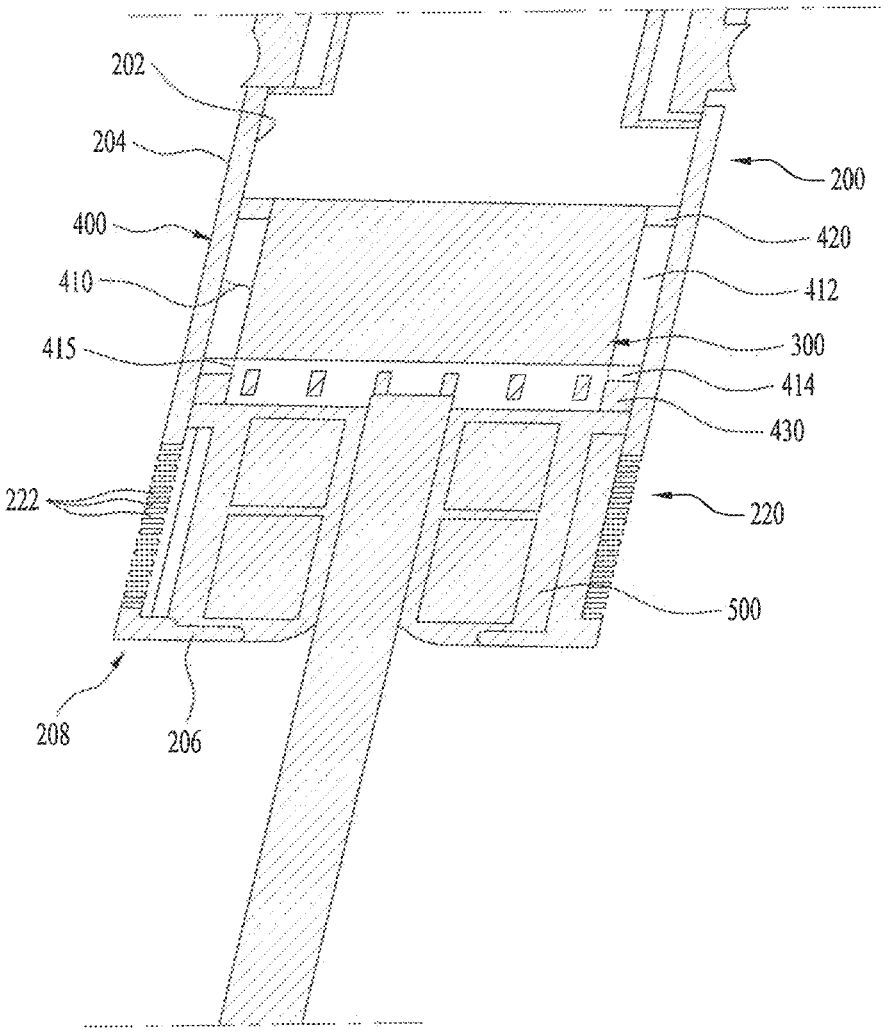
FIG. 5 is a view illustrating a section of a handle portion in a hair dryer according to an embodiment.
Figure 6:
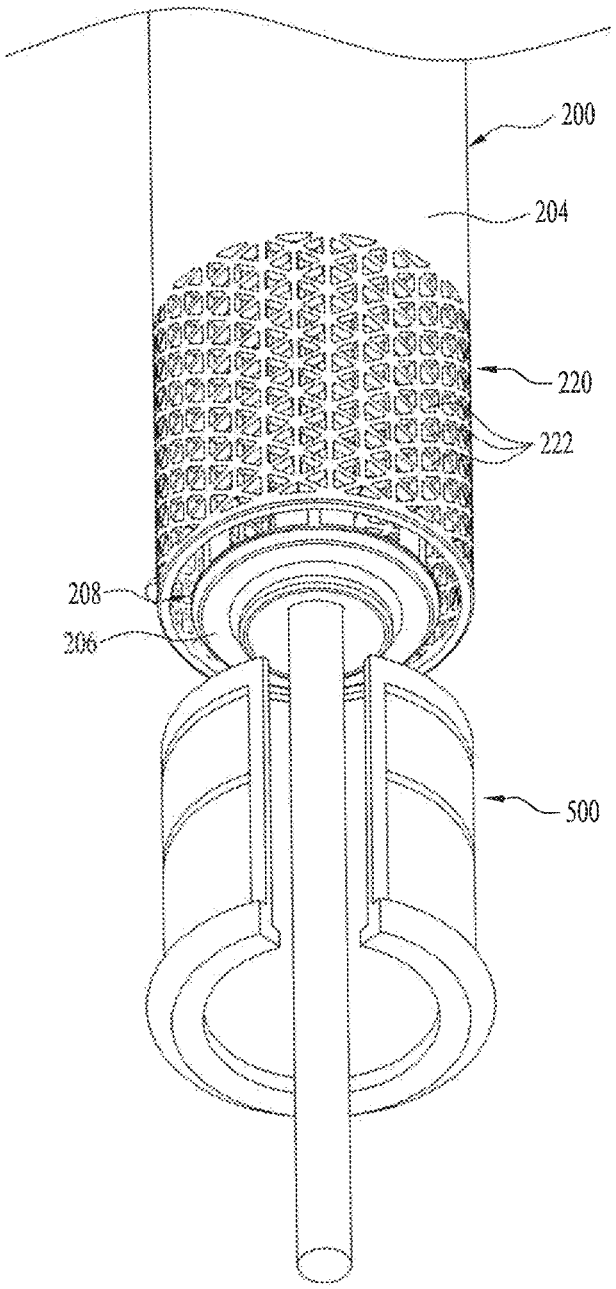
FIG. 6 is a view illustrating a filter detached from a handle portion in a hair dryer according to an embodiment.

FIG. 5 shows a cross-section illustrating the inside of the handle portion 200 in accordance with an embodiment. FIG. 6 shows a filter 500 detached from the handle portion 200 in accordance with an embodiment.

Referring to FIGS. 5 and 6, the hair dryer according to an embodiment may further include the filter 500. The filter 500 may be provided inside of the handle portion 200 to filter particles of gas entering the inside of the handle portion 200 through the gas inlet 220. The filter 500 may be arranged at an opposite side of the fan unit 300 based on the second closure portion 430, and one end facing the main body 100 may be coupled to the second closure portion 430.

The filter 500 may be provided in a cylindrical shape and provided such that an outer circumferential surface thereof faces the gas inlet 220. The gas entering from the gas inlet 220 may flow to the fan unit 300 through the filter 500. The filter 500 may be provided such that a circumferential surface thereof is tightly attached to the gas inlet 220 or provided to seal the gas inlet 220 from the gas path 150.

As shown in FIG. 6, the filter 500 may be provide in a pipe shape provided with a hollow portion. Therefore, the gas entering the inside of the handle portion 200 through the gas inlet 220 may be filtered while passing through the outer circumferential surface of the filter 500, and may flow to the fan unit 300 through a hollow portion of the filter 500.

A power line may be arranged in the hollow portion of the filter 500. The power line may be connected with an external power source, and may be connected with the fan unit 300, thereby supplying power to the fan unit 300.

As the filter 500 is arranged inside the handle portion 200 to face the gas inlet 220, the filter 500 may be arranged at an opposite side of the fan unit 300 based on the second closure portion 430. One end facing the fan unit 300 of the filter 500 may be coupled to the second closure portion 430 and then fixed to the inside of the handle portion 200.

The one end of the filter 500 and the second closure portion 430 may be coupled with each other in various ways. For example, the filter 500 may be coupled with the second closure portion 430 by screw coupling, magnetic coupling, or fitting coupling, for example. FIG. 5 schematically shows that the filter 500 arranged below the second closure portion 430 is coupled with the second closure portion 430 in accordance with an embodiment.

Referring to FIGS. 5 and 6, the gas inlet 220 may include a plurality of gas inlet holes 222 provided on the outer circumferential surface 204 of the handle portion 200, and providing communication between the outside of the handle portion 200 and the gas path 150. The gas inlet 220 may be arranged below the fan unit 300 and the second closure portion 430. That is, the gas inlet 220 may be arranged to be farther away from the main body 100 than the fan unit 300 and the second closure portion 430.

The gas inlet 220 may be provided on the outer circumferential surface 204 of the handle portion 200. That is, the plurality of gas inlet holes 222 forming the gas inlet 220 may be formed on the outer circumferential surface 204 of the handle portion 200. The gas inlet holes 222 may extend from the outer circumferential surface 204 of the handle portion 200 to the inner circumferential surface 202 of the handle portion 200 to allow gas outside of the handle portion 200 to enter the inside of the handle portion 200.

The outer circumferential surface of the filter 500 may face the inner circumferential surface 202 of the handle portion 200 to allow the gas entering from the plurality of gas inlet holes 222 to enter the gas path 150 through the filter 500. The filter 500 may be provided to filter particles in the gas entering the inside of the handle portion 200 through the gas inlet 220. The gas entering through the gas inlet 220 may flow to the main body 100 by passing through the fan unit 300, and particles in the gas may cause damage to or break the fan unit 300. Therefore, the filter 500 may be arranged at the inner side of the gas inlet 220, and the gas entering through the gas inlet 220 may be filtered while passing through the filter 500, and then may flow to the fan unit 300.

Referring to FIG. 6, the handle portion 200 may be provided with a filter insertion unit 208 formed on or at an end surface 206 arranged to be opposite to the main body 100, and the filter 500 may be inserted into the filter insertion unit 208. The filter 500 may be inserted into the handle portion 200 through the filter insertion unit 208 and therefore the one end may be coupled to the second closure portion 430.

The handle portion 200 may be provided with the gas inlet 220 on the outer circumferential surface 204, and the gas inlet 220 may be arranged at the end of the handle portion 200, that is, a lower portion of the handle portion 200 in accordance with an arrangement relationship with the fan unit 300. Also, the handle portion 200 may be provided with the filter insertion unit 208 on the end surface 206 opposite to the main body 100, that is, a lower surface. The filter insertion unit 208 may include a filter insertion hole into which the filter may be inserted, and the filter 500 may be inserted into the handle portion 200 through the filter insertion unit 208 along the lengthwise direction of the handle portion 200.

The filter 500 may be inserted through the filter insertion unit 208 and therefore its one end facing the main body 100 may face the second closure portion 430 and be coupled with the second closure portion 430. The gas inlet 220 may be provided at the lower side of the handle portion 200 and therefore the filter 500 inserted through the filter insertion unit 208 may be arranged at the inner side of the gas inlet 220.

Embodiments disclosed herein are directed to a hair dryer that substantially obviates one or more problems due to limitations and disadvantages of the related art.

Embodiments disclosed herein provide a hair dryer that may effectively attenuate vibration or noise generated from a fan unit. Embodiments disclosed herein further provide a hair dryer having a structure that may effectively attenuate noise generated by gas flow. Embodiments disclosed herein also provide a hair dryer that may attenuate noise as a fan unit is arranged in a handle portion effectively and stably.

Additional advantages, objects, and features will be set forth in part in the description and in part will become apparent to those having ordinary skill in the art upon examination of the disclosure or may be learned from practice. The objectives and other advantages may be realized and attained by the structure particularly pointed out in the written description and claims hereof as well as the appended drawings.

In one embodiment, an empty space that communicates with a path between a fan unit and a gas inlet is formed, whereby gas flow noise generated from the gas inlet and the fan unit may be attenuated. Driving noise of the fan unit, which passes through a handle portion and then is radiated to the outside, may be attenuated, and moreover, flow noise of gas generated near the gas inlet and the fan unit may be attenuated.

In a hair dryer having a structure in which a suction inlet, a motor, and a discharge outlet are connected with one another in due order, a noise attenuation portion having a noise attenuation space connected between the suction inlet, that is, the gas inlet and the fan unit may be provided.

The noise attenuation space may correspond to an empty space, and may be charged with the air therein. One side of the noise attenuation space may communicate with the gas path but the other side of the noise attenuation space may be closed, whereby the gas may not flow in the noise attenuation space.

The noise attenuation space may be provided with an inner wall separated from an outer wall of the handle portion, and may be formed between the outer wall of the handle portion and a motor housing of the fan unit.

A target frequency for noise attenuation may be determined depending on a volume of the noise attenuation space. That is, the noise attenuation space may be designed to have a resonant frequency corresponding to a frequency area where noise of a maximum value is generated. Therefore, in one embodiment, noise of the frequency area intended in design may be attenuated effectively.

The hair dryer according to an embodiment may include a main body, a handle portion (handle), a gas path (flow path), a fan unit (fan), and a noise attenuation portion. The main body may include a gas discharge outlet (discharge outlet) through which gas may be discharged to the outside. The handle portion may extend from the main body, and include a gas inlet (inlet) through which external gas may enter the handle portion.

The gas path may extend from the gas inlet to the gas discharge unit to flow the gas. The fan unit may be provided inside of the handle portion, and may be provided on or in the gas path to flow the gas.

The noise attenuation portion may be provided inside of the handle portion, and may be provided to surround at least a portion of the fan unit along an inner circumferential direction of the handle portion and attenuate noise generated from the fan unit.

As the noise attenuation portion surrounding the fan unit is provided, driving noise radiated from the fan unit may be attenuated and flow noise of the gas flowing in accordance with the fan unit may also be attenuated.

The noise attenuation portion may include a noise attenuation space where noise generated from the fan unit is attenuated, and the noise attenuation space may be arranged between an inner circumferential surface of the handle portion and the fan unit to surround the fan unit. The noise attenuation space may include an opening area one end of which facing the main body is closed with respect to the gas path and detached from the gas path and the other end facing the gas inlet communicates the noise attenuation space with the gas path.

The fan unit may include a fan motor, and a fan rotated by the fan motor. The fan may be arranged at an end portion or end of the fan motor, which faces the gas inlet. The opening area may be arranged to be closer to the gas inlet than the fan.

The hair dryer may further include a first closure portion protruded from the inner circumferential surface of the handle portion, and having a ring shape extended along the inner circumferential direction of the handle portion. The one end of the noise attenuation space may be closed by the first closure portion with respect to the gas path. The fan unit may be connected with the first closure portion and fixed to be spaced apart from the inner circumferential surface of the handle portion.

The fan unit may include a fan motor rotating the fan, and a motor housing accommodating the fan motor therein. The motor housing may have one end facing the main body and coupled with the first closure portion, and the noise attenuation space may be formed between the motor housing and the inner circumferential surface of the handle portion.

The hair dryer may further include a fan unit holder extended from the first closure portion to the gas inlet, and accommodating the fan unit therein. The noise attenuation space may be formed between an outer side of the fan unit holder and the inner circumferential surface of the handle portion.

The hair dryer may further include a second closure portion spaced apart from the fan unit toward the gas inlet and protruded from the inner circumferential surface of the handle portion, and having a ring shape extended along the inner circumferential direction of the handle portion. The opening area may be formed between the fan unit and the second closure portion.

The second closure portion may have a protrusion height higher than that of the first closure portion. The opening area may be opened to cross a lengthwise direction of the handle portion.

The hair dryer may further include a filter provided inside of the handle portion, that filters particles of gas entering through the gas inlet. The filter may be arranged to be opposite to the fan unit based on the second closure portion, and one end facing the main body may be coupled to the second closure portion.

The gas inlet may include a plurality of gas inlet holes provided on an outer circumferential surface of the handle portion, communicating the outside of the handle portion with the gas path, and the filter may have an outer circumferential surface provided to face the inner circumferential surface of the handle portion and filter the gas entering from the plurality of gas inlet holes.

The handle portion may be provided with a filer insertion unit formed on an end surface opposite to the main body to allow the filter to be inserted thereto, and the filter may be inserted into the handle portion through the filter insertion unit and its end may be coupled to the second closure portion.

According to embodiments disclosed herein, a hair dryer that may effectively attenuate vibration or noise generated from a fan unit may be provided. Further, according to embodiments disclosed herein, a hair dryer having a structure that may effectively attenuate noise generated by gas flow may be provided. Also, according to embodiments disclosed herein, a hair dryer that may attenuate noise, as a fan unit is arranged inside of a handle portion, effectively and stably may be provided.

It is to be understood that both the general description and the description are exemplary and explanatory and are intended to provide further explanation as claimed.

It will be apparent to those skilled in the art that embodiments may be embodied in other specific forms without departing from the spirit and essential characteristics. Thus, embodiments are to be considered in all respects as illustrative and not restrictive. The scope should be determined by reasonable interpretation of the appended claims and all change which comes within the equivalent scope are included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible isn the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hair dryer, comprising:

a main body including a discharge outlet through which fluid is discharged outside of the main body;

a handle that extends from the main body, including an inlet through which external fluid enters the handle;

a flow path that extends from the inlet to the discharge outlet;

a fan provided inside of the handle, and provided in the flow path; and a noise attenuation portion provided inside of the handle and surrounding at least a portion of the fan along an inner circumferential direction of the handle, the noise attenuating portion attenuating noise generated by the fan, wherein the noise attenuation portion includes a noise attenuation space provided between the inner circumferential surface of the handle and the fan to space the handle and the fan apart, and wherein a first end of the noise attenuation space is closed and a second end of the noise attenuation space is open.

2. The hair dryer of claim 1, wherein the first end of the noise attenuation space faces the main body with respect to the flow path, and wherein the second end of the noise attenuation space faces the inlet and communicates with the flow path.

3. The hair dryer of claim 2, wherein the fan includes:

a fan motor; and a plurality of blades rotated by the fan motor, wherein the plurality of blades is arranged at an end of the fan motor, which faces the inlet.

4. The hair dryer of claim 3, wherein the open second end is closer to the inlet than the fan.

5. The hair dryer of claim 2, further comprising a first closure portion that protrudes from the inner circumferential surface of the handle, having a ring shape extended along the inner circumferential direction of the handle, wherein the first end of the noise attenuation space is closed by the first closure portion with respect to the flow path.

6. The hair dryer of claim 5, wherein the fan is connected with the first closure portion and fixed to be spaced apart from the inner circumferential surface of the handle.

7. The hair dryer of claim 6, wherein the fan includes:

a fan motor that rotates a plurality of blades; and a motor housing that accommodates the fan motor therein, wherein a first end of the motor housing faces the main body and is coupled with the first closure portion, and wherein the noise attenuation space is formed between the motor housing and the inner circumferential surface of the handle.

8. The hair dryer of claim 6, further comprising a fan holder that extends from the first closure portion to the inlet and accommodates the fan therein, wherein the noise attenuation space is formed between an outer side of the fan holder and the inner circumferential surface of the handle.

9. The hair dryer of claim 5, further comprising a second closure portion spaced apart from the fan toward the inlet, protruding from the inner circumferential surface of the handle, and having a ring shape that extends along the inner circumferential direction of the handle, wherein the open second end is formed between the fan and the second closure portion.

10. The hair dryer of claim 9, wherein the second closure portion has a protrusion height in a radial direction of the handle higher than a protrusion height of the first closure portion, and wherein the open second end is open to cross a lengthwise direction of the handle.

11. The hair dryer of claim 9, further comprising a filter provided inside of the handle, that filters particles of gas entering through the inlet, wherein the filter is arranged to be opposite to the fan based on the second closure portion, and one end of the filter faces for the main body and is coupled to the second closure portion.

12. The hair dryer of claim 11, wherein the inlet includes a plurality of inlet holes provided on an outer circumferential surface of the handle, that communicates an outside of the handle with the flow path, and wherein the filter has an outer circumferential surface provided to face the inner circumferential surface of the handle and filter fluid entering through the plurality of inlet holes.

13. The hair dryer of claim 12, wherein the handle is provided with a filer insertion unit formed on an end surface opposite to the main body to allow the filter to be inserted thereto, and wherein the filter is inserted into the handle through the filter insertion unit and an end of the filter is coupled to the second closure portion.

14. A hair dryer, comprising:

a main body including a discharge outlet through which fluid is discharged outside of the main body;

a handle that extends from the main body, including an inlet through which external fluid enters the handle;

a flow path that extends from the inlet to the discharge outlet;

a fan provided inside of the handle, and provided in the flow path; and a noise attenuation space provided inside of the handle and surrounding at least a portion of the fan along an inner circumferential direction of the handle, the noise attenuating portion attenuating noise generated by the fan, wherein the noise attenuation space is provided between the inner circumferential surface of the handle and the fan to space the handle and the fan apart, and wherein a first end of the noise attenuation space is closed and a second end of the noise attenuation space is open.

15. The hair dryer of claim 14, wherein the first end of the noise attenuation faces the main body with respect to the flow path, and wherein the second end of the noise attenuation space faces the inlet and communicates with the flow path.

16. The hair dryer of claim 15, wherein the fan includes:

a fan motor; and a plurality of blades rotated by the fan motor, wherein the plurality of blades is arranged at an end of the fan motor, which faces the inlet.

17. The hair dryer of claim 15, wherein the open second end is closer to the inlet than the fan.

18. The hair dryer of claim 15, further comprising a filter provided inside of the handle, that filters particles of gas entering through the inlet.

19. A hair dryer, comprising:

a main body including a discharge outlet through which fluid is discharged outside of the main body;

a handle that extends from the main body, including an inlet through which external fluid enters the handle;

a flow path that extends from the inlet to the discharge outlet;

a fan provided inside of the handle, and provided in the flow path; and a noise attenuation space provided inside of the handle and adjacent at least a portion of the fan, the noise attenuating portion attenuating noise generated by the fan, wherein the fan is spaced apart from the handle by the noise attenuation space, and wherein a first end of the noise attenuation space is closed with respect to the flow path, and wherein a second end of the noise attenuation space is open and communicates with the flow path.

20. The hair dryer of claim 19, further comprising a first closure portion that protrudes from an inner circumferential surface of the handle, having a ring shape extended along an inner circumferential direction of the handle, wherein the first end of the noise attenuation space is closed by the first closure portion with respect to the flow path, and wherein the fan is connected with the first closure portion and fixed to be spaced apart from the inner circumferential surface of the handle.

21. The hair dryer of claim 20, further comprising a fan holder that extends from the first closure portion to the inlet and accommodates the fan therein, wherein the noise attenuation space is formed between an outer side of the fan holder and the inner circumferential surface of the handle.

22. The hair dryer of claim 20, further comprising a second closure portion spaced apart from the fan toward the inlet, protruding from the inner circumferential surface of the handle, and having a ring shape that extends along the inner circumferential direction of the handle, wherein the open second end is formed between the fan and the second closure portion, wherein the second closure portion has a protrusion height in a radial direction of the handle higher than a protrusion height of the first closure portion, and wherein the open second end is open to cross a lengthwise direction of the handle.

23. The hair dryer of claim 22, further comprising a filter provided inside of the handle, that filters particles of gas entering through the inlet, wherein the filter is arranged to be opposite to the fan based on the second closure portion, and one end of the filter faces for the main body and is coupled to the second closure portion.

* * * * *